United States Patent [19]

Köhler

[11] 4,106,458

[45] Aug. 15, 1978

[54] FUEL INJECTOR

[75] Inventor: Wolfgang Köhler, Cologne, Fed. Rep. of Germany

[73] Assignee: Klockner-Humboldt-Deutz Aktiengesellschaft, Cologne, Fed. Rep. of Germany

[21] Appl. No.: 787,620

[22] Filed: Apr. 14, 1977

[30] Foreign Application Priority Data

Apr. 23, 1976 [DE] Fed. Rep. of Germany ..... 2617841

[51] Int. Cl.[2] ..... F02M 39/00

[52] U.S. Cl. ..... 123/139 AT; 123/139 AK; 123/32 JV

[58] Field of Search ..... 123/139 AT, 139 AK, 123/32 JV; 417/387, 388

[56] References Cited

U.S. PATENT DOCUMENTS

| | | | |
|---|---|---|---|
| 3,029,737 | 4/1962 | Bessiere | 417/387 |
| 3,516,395 | 6/1970 | Bassot et al. | 123/139 AK |
| 3,752,136 | 8/1973 | Knight et al. | 123/139 AT |
| 4,003,679 | 1/1977 | McManigill | 417/388 |

*Primary Examiner*—Charles J. Myhre
*Assistant Examiner*—R. A. Nelli
*Attorney, Agent, or Firm*—Walter Becker

[57] ABSTRACT

A fuel injector for internal combustion engines which comprises a fuel pump, a fuel injection pump with volume governor, and a fuel injection valve. A differential piston is arranged between the fuel injection pump and the fuel injection valve. The larger end face of the differential piston is acted upon by the fuel injection pump; the smaller end face is acted upon by the fuel pump through a check valve. The differential piston is connected with valve which limits the feed pressure of the fuel pump is provided in a connecting line between the fuel pump and the fuel injection pump. A pressure valve which determines the fuel pressure ahead of the fuel injection pump is arranged in a return line from the fuel injection pump to the fuel tank.

2 Claims, 1 Drawing Figure

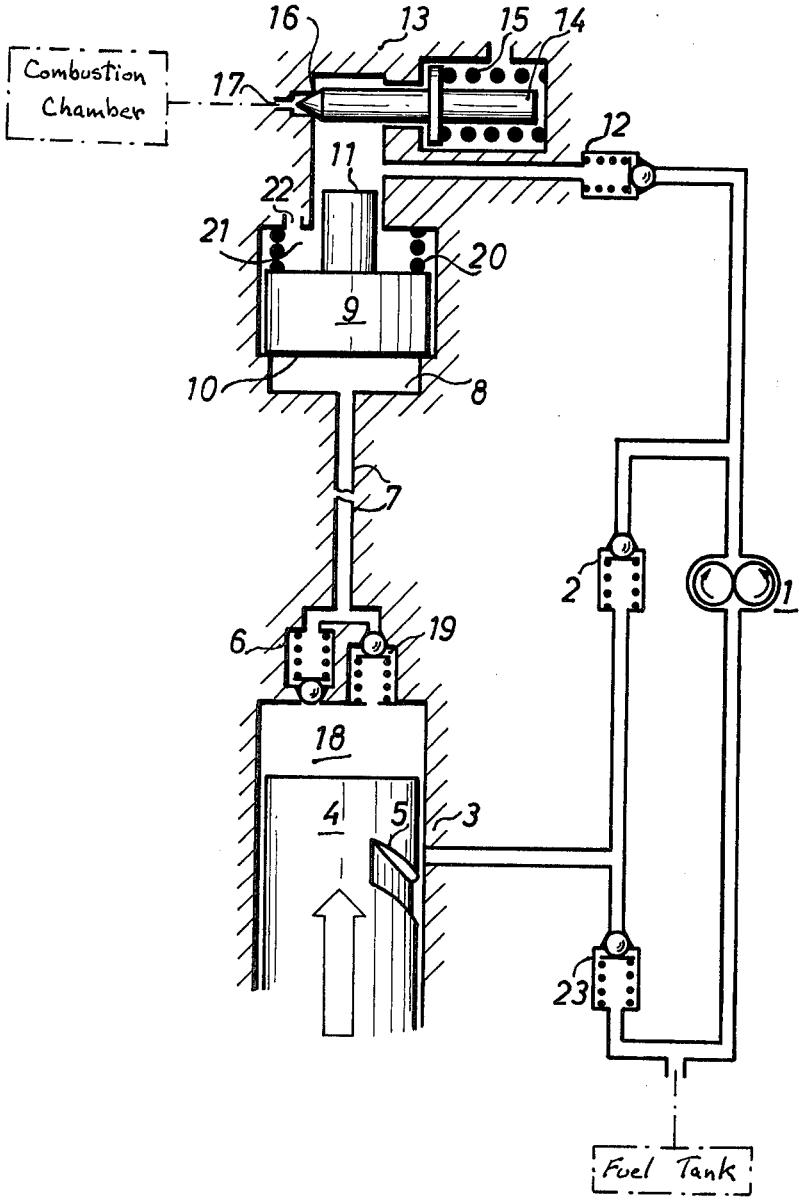
Combustion Chamber
16
13
15
14
17
12
11
22
21
20
9
10
8
7
2
1
6
19
18
4
5
3
23
Fuel Tank

FUEL INJECTOR

The present invention relates to a fuel injector for internal combustion engines and comprises a fuel pump, a fuel injection pump with volume governor, and a fuel injection valve.

Such fuel injectors are generally known. With the heretofore known fuel injectors, the fuel injection pump is constructed as a single pump, an in-series pump, or a distributing pump. The fuel pump conveys the fuel from a fuel tank at more or less high pressure to the fuel injection pump which, depending upon the load and rotational speed of the internal combustion engine, supplies a specific amount of fuel at high pressure to the fuel injection valve.

Recent research in connection with endeavors to reduce exhaust emission and fuel consumption has led, among other things, to an increase in the injection pressure. The concept "high pressure injection" refers these days to introducing the fuel into the combustion chamber at injection peak pressures of about 800 bar. However, for fundamental tests one endaavors to achieve pressures over 2000 bar. These pressures are not obtainable with the injectors heretofore in use.

It is therefore an object of the present invention to provide a fuel injector for such high pressures.

This object and other objects and advantages of the present invention will appear more clearly from the following specification in connection with the accompanying drawing which is a schematic illustration of a specific embodiment of a fuel injector according to the present invention.

The fuel injector pursuant to the present invention is characterized primarily in that a differential piston is arranged between the fuel injection pump and the fuel injection valve. The larger end face of the differential piston is acted upon by the fuel injection pump, and the smaller end face is acted upon by the fuel pump through a check valve. The differential piston is connected with the fuel injection valve through a pressure line. A check valve which limits the feed pressure of the fuel pump is provided in a connecting line between the fuel pump and the fuel injection pump. A pressure valve which determines the fuel pressure ahead of the fuel injection pump is arranged in a return line from the fuel injection pump to the fuel tank.

Pursuant to a feature of the present invention, the differential piston is arranged in the housing of the fuel injection valve.

Referring now to the drawing in detail, a fuel pump 1 conveys fuel from a fuel tank through a check valve 2 to a fuel injection pump 3 which has a rotatable piston 4. The piston 4 on its periphery has a slanted control groove 5 for governing volume. The fuel pump 3 conveys the fuel further through a pressure valve 6 and pressure line 7 into a cylinder 8, in which is arranged an axially movable differential piston 9. As a result, the larger end face 10 of the differential piston 9 is acted upon by the fuel injection pump 3. The smaller end face 11 of the differential piston 9 is directly acted upon by the fuel pump 1 through a check valve 12. In this connection, the pressure during the filling process is limited by means of the check valve 2. By the differential piston 9, the fuel is pressed to a fuel injection valve 13, the needle valve 14 of which opens counter to the fuel flow-through direction and is moved onto a valve seat 16 in the closed position by a valve spring 15. The injection opening 17 leads to the combustion chamber.

The fuel injection begins by feeding fuel to the fuel injection pump 3 and ends when the pressure in the pressure chamber 18 of the fuel injection pump 3 is relieved by the control groove 5. At this time, the pressure in the pressure line 7, by means of a check valve 19, is relieved to a predetermined pressure, in which connection the differential piston 9 returns to its normal or starting position. For this purpose a return spring 20 is provided which is arranged in a spring space 21 which has a leakage bore 22 which may be connected with the fuel tank. The injected fuel is replaced by the fuel pump 1 for the next injection through the check valve 12. The pressure of the fuel pump 1 can, by means of the check valve 2, be so adjusted that even without special return elements the differential piston 9 may return to its starting position solely by means of the fuel feed pressure. In this connection, the fuel pressure ahead of the injection pump 3 is kept appropriately low by means of a check valve 23 which is arranged between the fuel injection pump 3 and the fuel tank.

With the design pursuant to the present invention, it is possible to construct the fuel injection pump in a customary manner. The fuel injection pump, with today's easily controllable peak pressures, takes over the governing of the volume while by means of the differential piston a pressure increase is obtained which is in conformity with the proportion of the two end faces. In this respect, the fuel pump is so designed that it acts upon the end face on the injection side of the differential piston with a higher pressure than the injection pump itself, so that the differential piston, as a result of the pressure differential during the suction or intake stroke, returns to its normal or starting position even without additional return elements.

In the specific embodiment illustrated in the drawing, the differential piston 9 and the fuel injection valve 13 are combined in one structural unit. Combining all high pressure elements in one housing section has the advantage that between the differential piston and the injection valve no free fuel lines need be used, which, due to their elasticity and the compressibility of the volume of fuel contained therein, lead to inexact injection quantities. Further, oscillations or vibrations and the problems caused thereby, such as cavitation, post injection, etc., are easier to control.

It is, of course, to be understood that the present invention is by no means limited to the specific showing of the drawing, but also encompasses any modifications within the scope of the appended claims.

What I claim is:

1. A fuel injector for internal combustion engines having a fuel tank, which comprises: fuel pumping means in communication with said fuel tank; fuel injection pumping means in communication with said fuel pumping means; volume governing means associated with said fuel injection pumping means; fuel injection valve means in communication with said fuel pumping means and said fuel injection pumping means; differential piston means interposed between and in communication with said fuel injection pumping means and said fuel injection valve means, said differential piston means having a first larger end face which is in communication with said fuel pumping means, and a second smaller end face which is in communication with said fuel pumping means; first check valve means interposed between said fuel injection valve means and said fuel pumping means;

second check valve means interposed between said fuel pumping means and said fuel injection pumping means for limiting the feed pressure of said fuel pumping means; and pressure valve means interposed between said fuel injection pumping means and said fuel tank for determining the fuel pressure ahead of said fuel injection pumping means.

2. A fuel injector according to claim 1, which includes a housing common to both said differential piston means and said fuel injection valve means.

* * * * *